US008112020B2

(12) United States Patent
Mabuchi et al.

(10) Patent No.: US 8,112,020 B2
(45) Date of Patent: Feb. 7, 2012

(54) DEVELOPING DEVICE AND IMAGE-FORMING APPARATUS

(75) Inventors: Sayo Mabuchi, Osaka (JP); Hiroyuki Hamakawa, Osaka (JP); Akihiro Watanabe, Osaka (JP); Masashi Fujishima, Osaka (JP); Hiroshi Yamazaki, Osaka (JP); Asami Kotera, Osaka (JP)

(73) Assignee: KYOCERA MITA Corporation, Osaka (JP)

( * ) Notice: Subject to any disclaimer, the term of this patent is extended or adjusted under 35 U.S.C. 154(b) by 373 days.

(21) Appl. No.: 12/405,446

(22) Filed: Mar. 17, 2009

(65) Prior Publication Data

US 2009/0311012 A1 Dec. 17, 2009

(30) Foreign Application Priority Data

Jun. 12, 2008 (JP) ..... 2008-154170

(51) Int. Cl.
*G03G 15/08* (2006.01)

(52) U.S. Cl. ..... 399/286

(58) Field of Classification Search ..... 399/119, 399/252, 279–286; 430/48, 83, 84, 110.3, 430/111.41
See application file for complete search history.

(56) References Cited

U.S. PATENT DOCUMENTS

| | | | | |
|---|---|---|---|---|
| 6,316,157 | B1 * | 11/2001 | Yoshikawa et al. | 430/108.3 |
| 7,217,483 | B2 * | 5/2007 | Nozomi et al. | 430/96 |
| 2008/0069601 | A1 * | 3/2008 | Oshiba et al. | 399/286 |

FOREIGN PATENT DOCUMENTS

| | | |
|---|---|---|
| CN | 1755595 | 4/2006 |
| JP | 07-013415 | 1/1995 |

* cited by examiner

*Primary Examiner* — Hoan Tran
(74) *Attorney, Agent, or Firm* — Frommer Lawrence & Haug LLP

(57) ABSTRACT

Embodiments relate to a developing device for use in an image-forming apparatus including a developing roller having a conductive base surface which may be covered with a resin layer containing an ion conductive material and a silicone-modified urethane resin having an ether structure. The resin layer may be a product of a crosslinking reaction of the silicone-modified urethane resin and the ion conductive material in the presence of a crosslinking agent and a crosslinking catalyst.

20 Claims, 3 Drawing Sheets

DEVELOPING DEVICE AND IMAGE-FORMING APPARATUS

INCORPORATION BY REFERENCE

This application is based upon and claims the benefit of priority from the corresponding Japanese Patent Application No. 2008-154170, filed Jun. 12, 2008, the entire contents of which are incorporated herein by reference.

FIELD OF THE INVENTION

The present invention relates to a developing device for use in a copy machine, a printer, a facsimile machine, and a multifunctional machine that combines these machines, all of which utilize an electrophotographic method and an image-forming apparatus using the developing device.

BACKGROUND OF THE INVENTION

Conventionally known image formation methods include forming a thin layer of a toner on a developing roller by means of a magnetic brush. The magnetic brush formed on a developer supporting member supports a two-component developer. Then the toner on the developing roller develops an electrostatic latent image on an electrostatic latent image supporting member.

Developing rollers used in an image-forming apparatuses and having conductive base surfaces covered with resin are known. In one such example, a developing roller has a resin cover layer that contains an electron conductive material and an ion conductive material, and has a volume resistivity (R) ranging from about $10^7$ to about $10^{10}$ Ω·cm when the ion conductive material is mixed. The resin cover layer may comprise acrylic resin, epoxy resin, resol resin, and the like.

When small particle diameter toner is used, it is strongly affected by image force and van der Waals force. Therefore, even when a development bias is applied on the developing roller, the small particle diameter toner does not fly to an electrostatic latent image on a photoconductor. This results in a problem with deterioration of developing properties. In order to cause the small particle diameter toner to fly to the electrostatic latent image on the photoconductor, it is necessary to enhance releasability of the toner from the developing roller. In order to increase toner releasability, the developing roller surface may be preferably covered with a resin having superior releasability properties. Examples of such resin include fluorine resin, silicone resin, and the like. However, when a positively charged toner is used, these types of resins will cause a problem because the toner becomes charged-up electrically due to friction. Electrically charged up toner cannot easily fly from the developing roller to the electrostatic latent image on the photoconductor, and deterioration of image density results. Using a urethane resin as the cover resin may suppress such an electric charge-up, but there remains a problem of the urethane resin having unfavorable toner releasability.

Furthermore, covering the surface of the developing roller with a resin creates an additional problem of electric charge accumulation in the resin layer. Dispersing carbon black or a metal-based conductive material in the resin layer is one known method to curb this problem. However, in some cases uneven dispersion of the conductive material within the resin may not prevent the accumulation of electric charge.

There remains a need in the art for a developing device comprising a resin-covered developing roller with improved toner releasability as well as decreased electric charge accumulation in the resin layer.

Citation or identification of any document in the application is not an admission that any such document is available as prior art to the present inventor.

SUMMARY

According to one embodiment of the present invention a developing device may comprise a developing roller that has improved toner releasability and solves the problem of electric charge accumulation in the resin layer caused by inferior dispersion of a conductive material within the resin layer. An image-forming apparatus using the developing device may comprise another embodiment of present invention.

A developing device according to one aspect of the present invention that solves the above task may comprise a developing roller that is disposed in position opposed to an electrostatic latent image supporting member, and supports and conveys a toner on a surface thereof. Further, a conductive base surface of the developing roller may be covered with a resin layer comprising an ion conductive material and a silicone-modified urethane resin. The silicone-modified urethane resin may further comprise an ether structure.

A developing device according to another embodiment of the present invention may comprise a developing roller and a magnetic roller. The developing roller may be disposed in a position opposed to an electrostatic latent image supporting member that may support and convey a toner on a surface thereof. The magnetic roller may support a two-component developer material containing the toner and a carrier, and the magnetic roller may convey the toner to the developing roller. According to such an embodiment, a conductive base surface of the developing roller may be covered with a resin layer comprising an ion conductive material.

A resin for covering the surface of the conductive base of a developing roller according to another embodiment of the present invention may comprise a silicone-modified urethane resin further comprising an ether structure.

According to the present invention, releasability of the toner from the developing roller may be increased because the resin layer of the developing roller may comprise a silicone-modified urethane resin. Furthermore the dispersibility of the ion conductive material within the resin layer improves due to the ether groups introduced in the urethane resin. As a result the electric charge accumulation within the resin layer may be suppressed, and also electric charge-up of the toner may be suppressed. Therefore, the developing device of the present invention may increase releasability of the toner from the developing roller while also suppressing electric charge-up of the toner.

The above and other objects, features, and advantages of the present invention will be more apparent from the following detailed description of preferred embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which exemplary embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which.

DETAILED DESCRIPTION OF THE PREFERRED EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents.

One embodiment of the present invention, concerning a developing device and an image-forming apparatus comprising the developing device of the present invention, will be described in detail below.

Figure 1:
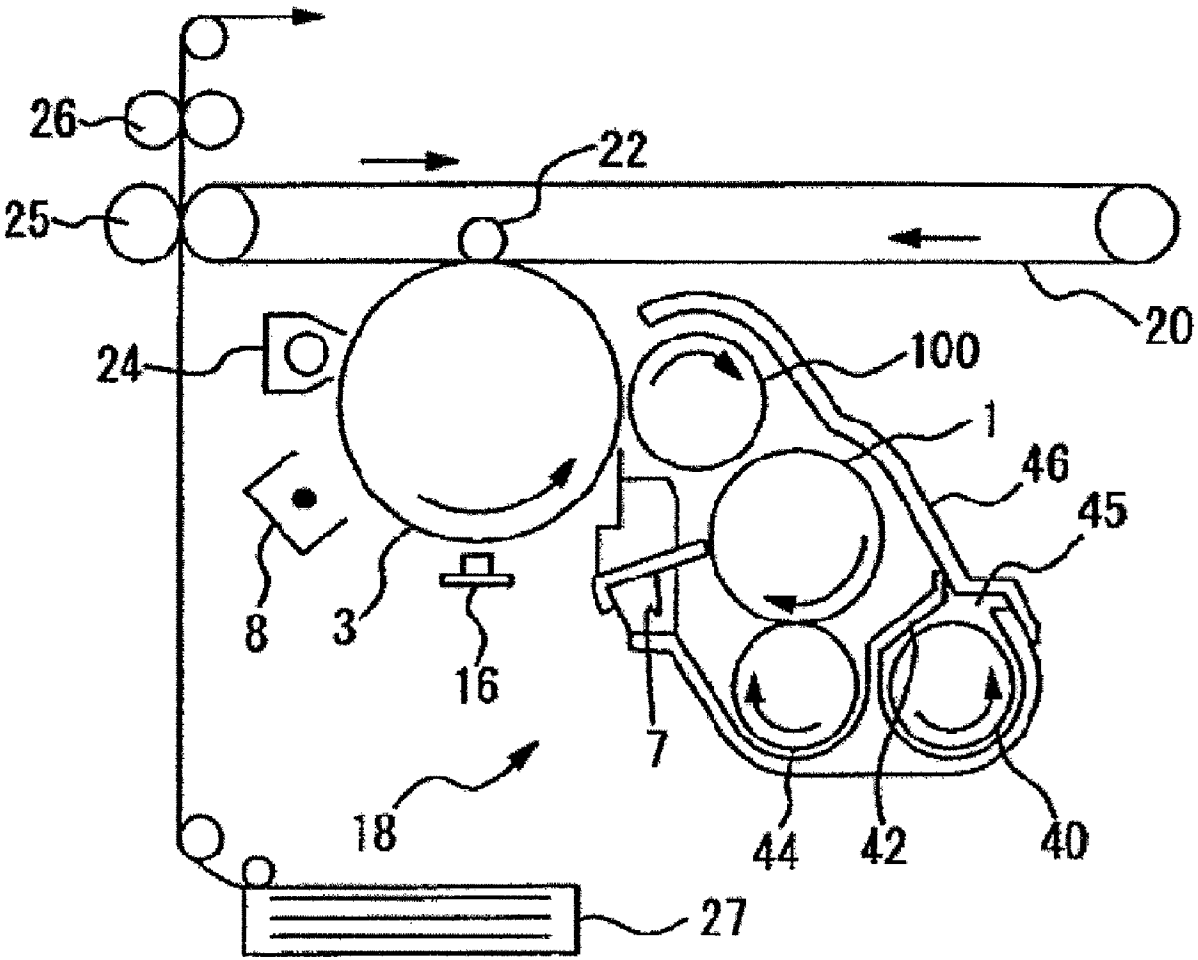
FIG. 1 is a schematic cross-sectional view of a developing device and an image-forming apparatus, both of which utilize a developing method according to an embodiment of the present invention.

Firstly, an example of an image-forming apparatus that is equipped with a developing roller of the present invention will be described with reference to FIG. 1. FIG. 1 is a vertical cross-sectional schematic diagram of the image-forming apparatus that is equipped with the developing device according to an embodiment of the present invention. The developing device comprises a developing roller 100 that is disposed in a position opposed to a photoconductor 3. The photoconductor 3 is an electrostatic latent image supporting member. The developing roller 100 supports and conveys a toner on a surface thereof. The developing device further comprises a magnetic roller 1 that supports a two-component developer material containing the toner and a carrier. The magnetic roller conveys the toner to the developing roller. The developing device operates in the following manner: 1) forming a thin layer of toner on the developing roller 100 by means of a magnetic brush; 2) flying the toner from the thin layer of toner to the photoconductor 3; and 3) developing the electrostatic latent image formed on the photoconductor 3. The magnetic brush is made of a two-component developer material containing a magnetic carrier and a toner, and is supported on the magnetic roller 1.

The image-forming apparatus shown in FIG. 1 comprises: an electrical charging device 8, an exposure device 16, a developing device 18, an intermediate transfer belt 20, a primary transfer roller 22, a secondary transfer roller 25, a fixing device 26, and a cleaning device 24. Disposed around the photoconductor 3 are: the electrical charging device 8, the exposure device 16, the developing device 18, the intermediate transfer belt 20, and the primary transfer roller 22.

The image-forming apparatus conducts image formation as follows. The electrical charging device 8 uniformly charges the surface of the photoconductor 3. Then the electrically charged surface is exposed to the exposure device 16, resulting in the formation of the electrostatic latent image. The obtained electrostatic latent image is attached with the toner and developed as a toner image by the developing device 18. The primary transfer roller 22 transfers the toner image from the photoconductor 3 onto the intermediate transfer belt 20 which is an intermediate transfer body. After the toner images with a plurality of colors are transferred onto the intermediate transfer belt 20 so as to be overlaid, the toner image is then transferred onto an object. The secondary transfer roller 25 delivers the object from a paper cassette 27 to a secondary transfer position. The object is delivered to the fixing roller 26 which is a fixing device. After fixing the toner image on the object, the object is, for example, discharged to a paper discharge tray (not shown). Undeveloped toner left on the surface of the photoconductor 3 after transfer is removed by the cleaning device 24.

Some examples of the photoconductor 3 include but are not limited to: an inorganic photoconductor such as selenium and amorphous silicon; an organic photoconductor (OPC) having, on a conductive base, a singular or multiple of photosensitive layers containing an electric charge generating agent, an electric charge transfer agent, a binder resin, and the like. Some examples of the electrical charging device 8 include but are not limited to a scorotron wire, a charging roller, a charging brush, and the like. Some examples of an exposure light of the exposure device 16 include but are not limited to an exposure light from an LED, a semiconductor laser, and the like. Furthermore, some examples of the cleaning device 24 include but are not limited to cleaning blade, a cleaning brush, a cleaning roller, and the like. Products available in the public domain may be used for each of these examples.

The developing device 18 comprises: a magnetic roller 1, a developing roller 100, and a regulating blade 7 for maintaining the height of the magnetic brush formed on the magnetic roller 1. The magnetic roller 1 is constructed of a magnetic member that is disposed inside the magnetic roller 1 and has a plurality of magnetic poles and a sleeve that rotates around an outer circumference part of the magnetic member. The developing roller 100 is constructed of a magnetic member that is disposed inside the developing roller and has a magnetic pole with a polarity opposite of the magnetic pole of the magnetic roller 1. This magnetic member is disposed in an opposed position of the magnetic roller 1. The developing roller 100 is further constructed of a sleeve that rotates around an outer circumference part of the magnetic member.

Furthermore, the image-forming apparatus according to an embodiment of the present invention comprises: a toner container (not shown) that stores the toner and a two-component developer containing section 45 that contains the two-component developer. The apparatus further comprises a first agitation screw 40 and a second agitation screw 44 that agitate and electrically charge, with the carrier, the toner which is supplied by the two-component developer containing section 45; a divider 42 disposed between the first agitation screw 40 and the second agitation screw 44; the magnetic roller 1 which is a two-component developer supporting member; a developing roller 100 which is a toner supporting member; and a housing 46 that houses the first agitation screw 40 and the second agitation screw 44. The two-component developer is allowed to freely move between the first agitation screw 40 and the second agitation screw 44 at the outer sides beyond both ends of the divider 42. The two-component developer circulates between the first agitation screw 40 and the second agitation screw 44. The two-component developer that is supplied from the first agitation screw 40 to the second agitation screw 44 is then supplied to the magnetic roller 1.

The two-component developer supplied to the magnetic roller 1 forms the magnetic brush due to the magnetic pole inside the magnetic roller 1. Subsequently, the magnetic brush moves due to the rotation of the sleeve disposed on the surface of the magnetic roller 1. The thickness of the magnetic brush is regulated when the magnetic brush passes the regulating blade 7. A voltage application means (not shown) applies voltage to generate a difference in an electrical potential is generated between the developing roller 100 and the magnetic roller 1. Consequently, when the thickness regulated magnetic brush moves close to the developing roller 100, only electrically charged toner moves to the developing roller 100 due to electrical potential difference. Toner that moves to the developing roller 100 forms a uniform toner layer. A voltage application means (not shown) also generates an electrical potential difference between the photoconductor 3 and the developing roller 100. Consequently, development is based on the electrostatic latent image formed on the photoconductor 3 by the difference in the electrical potential.

Figure 2:
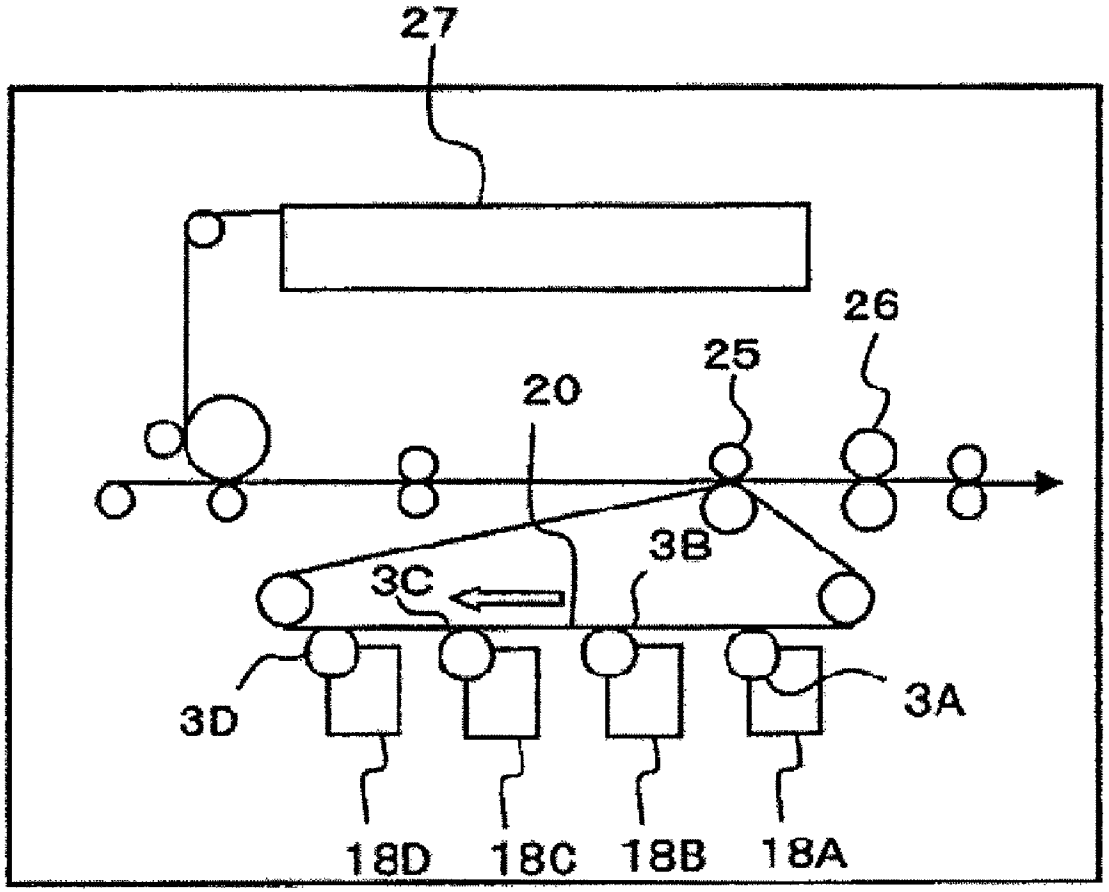
FIG. 2 is a schematic block diagram illustrating one example of a tandem type color image-forming apparatus that utilizes the developing device shown in FIG. 1.

One example of an image-forming apparatus according to an embodiment of the present invention is, as shown in FIG. 2, a tandem type (indirect transfer tandem type) color image-forming apparatus. The tandem type color image-forming apparatus has four drum shaped photoconductors, 3A, 3B, 3C and 3D, and four developing devices, 18A, 18B, 18C and 18D, aligned along the intermediate transfer belt 20. Based on an electrostatic latent image, toner images are formed by the developing devices 18A, 18B, 18C and 18D. These toner images are formed on the photoconductors 3A, 3B, 3C and 3D and contain a magenta toner, a cyan toner, a yellow toner and a black toner corresponding to the photoconductors 3A, 3B, 3C and 3D, respectively. Then, the toner images formed on the photoconductors, 3A, 3B, 3C and 3D, are transferred onto the intermediate transfer belt 20 in order respectively, starting with the photoconductor 3A located on the upstream side. Then the full color image transferred onto the intermediate transfer belt 20 is then transferred onto an object delivered from the paper cassette 27 by the secondary transfer roller 25. After the full color image is fixed by the fixing roller 26, the object is discharged.

Figure 3:
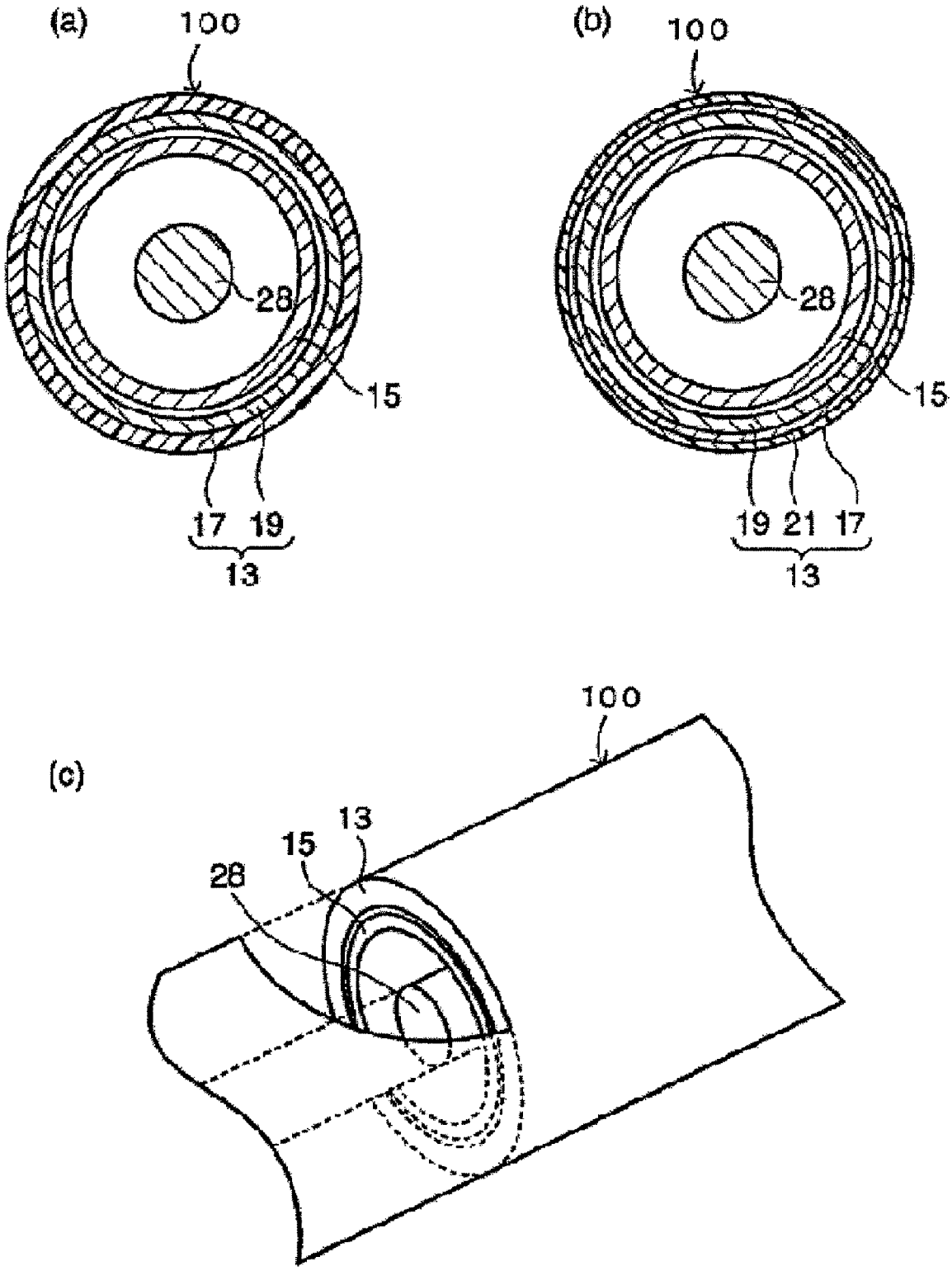
FIG. 3 is a schematic cross-sectional view of a developing roller according to an embodiment of the present invention.

Next, a configuration of a developing roller according to one aspect of the present invention will be described. FIG. 3 shows the developing roller 100 according to one embodiment of the present invention. As shown in FIG. 3(*a*) to FIG. 3(*c*), such a developing roller comprises a cylindrical rotating sleeve 13, and a fixed magnet 15 installed inside the rotating sleeve 13. The rotating sleeve 13 rotates around the fixed magnet 15 that is in a fixed position. As shown in FIG. 3(*a*), in the rotating sleeve 13, a conductive base 19 is covered with a resin layer 17. The conductive base 19 may be for example, a cylindrical member made of aluminum or stainless steel. Furthermore, as shown in FIG. 3(*b*), a surface treated layer 21 may be disposed on a surface of the conductive base 19. Moreover, examples of the surface treated layer 21 include without limitation a plated layer and an alumite layer. Reference character 28 in FIG. 3 is a metal core.

A developing roller according to an embodiment of the present invention having a surface of a conductive base may be made of, for example aluminum. The surface may be covered with a silicone-modified urethane resin layer comprising an ion conductive material.

In another embodiment of the present invention the silicone-modified urethane resin may be obtained by crosslinking urethane polymer with a crosslinking agent, for example, polyfunctional isocyanate compound. The urethane polymer may be prepared by reacting a diol with a poly- or bifunctional isocyanate compound. The diol may be obtained by reacting a silicone diol having terminal hydroxyl groups with a polycarbonate diol. Examples of the silicone diol having terminal hydroxyl groups include, but are not limited to, a polysiloxane having carbinol-modified terminal groups, and the like. Furthermore, examples of the diol components other than the above-described polycarbonate diol include, but are not limited to, polyether diol, polyester diol, and the like. These other diol components may preferably comprise an ether group. A polyether diol may be a product of the addition polymerization of one or more alkylene oxides, such as ethylene oxide, propylene oxide, butylene oxide, tetrahydrofuran, and the like, and a compound having at least two terminal active hydrogen groups. The compound having at least two active hydrogen groups may be selected from the group comprising dihydroxy alcohols such as ethylene glycol; propylene glycol; 1,3-propanediol; 1,3-butanediol; 1,4-butanediol; hexamethylene glycol; bisphenol-A; hydroquinone; and the like. Furthermore, together with this diol component, another diol component having a side chain comprising one or more unsaturated aliphatic hydrocarbon groups may be used. The unsaturated aliphatic hydrocarbon groups may serve as the crosslinking points in a silylation and other crosslinking reactions. Examples of the bifunctional isocyanate compounds include, but are not limited to, 2,4-tolylene diisocyanate; 2,6-tolylene diisocyanate; 1-methylcyclohexylene-2,4-diisocyanate; 1-methylcyclohexylene-2,6-diisocyanate; 4,4'-diphenylmethane diisocyanate; 4,4'-dicyclohexylmethane diisocyanate; 1,5-naphthalene diisocyanate; 3,3'-dimethyl-4,4'-biphenylene diisocyanate; xylylene diisocyanate; hydrogenated xylylene diisocyanate; isoholon diisocyanate; hexamethylene diisocyanate; 2,2,4-trimethyl hexamethylene diisocyanate; 2,4,4-trimethyl hexamethylene diisocyanate; and the like. These compounds may be used alone or in combination. Furthermore, a bi- or polyfunctional isocyanate compound having an unsaturated hydrocarbon substituted group within the molecule may be used.

Additionally, the polydiol component and/or the bi- or polyfunctional isocyanate component may further comprise an ether group on a side chain. The diol and the bi- or polyfunctional isocyanate components comprising a side chain having the ether group of a polyalkylene oxide such as polyethylene oxide may be used since the resulting macromolecule has an excellent ion conductivity.

In order to obtain the urethane polymer, the diol component and the bi- or polyfunctional isocyanate compound may be reacted in an appropriate solvent in the presence of a urethane-forming catalyst. Examples of the solvent used include, but are not limited to, an aliphatic solvent such as hexane and cyclohexane; an aromatic solvent such as toluene and xylene; a ketone solvent such as methyl ethyl ketone, methyl isobutyl ketone and cyclohexanone; an ester solvent such as ethyl acetate and butyl acetate; an ether solvent such as tetrahydrofuran, 1,4-dioxane; and the like. These solvents may be used alone or in combination. However, due to an excellent solubility of the urethane polymer in ketone, ester, and ether solvents, these solvents may be preferred.

Examples of the urethane-forming catalyst include, but are not limited to, an organotin catalyst, such as dibutyltin dilaurate, stannous octoate, and the like; and an amine catalyst, such as N,N,N',N'-tetramethyl-1,3-butanediamine, and the like. These catalysts may be used alone or in combination. The urethane-forming catalyst may be used in a catalytic amount.

The obtained urethane polymer may have a weight average molecular weight ranging from about 10,000 to about 500,000; and preferably ranging from about 50,000 to about 200,000. The urethane polymer molecule may contain a soft segment that originates from the diol component, and a hard segment that originates from the bifunctional isocyanate compound.

The process of crosslinking the obtained silicone-modified urethane resin is described below. Examples of the crosslinking agents include, but are not limited to, organohydrogen polysiloxane that may have two or more hydrosilyl groups within one molecule. A crosslinking reaction may be conducted in the presence of a hydrosilylation catalyst. The organohydrogen polysiloxane that may have two or more hydrosilyl groups, may be used in the amount of about 0.1 to about 100 parts by weight (solid content) per 100 parts by weight of solid content of the urethane polymer having the side chains containing one or more unsaturated aliphatic hydrocarbon groups. Furthermore, examples of the hydrosilylation catalyst include, but are not limited to, a metal complexes of the transition metals of the platinum family such as platinum, palladium, iridium, rhodium, osmium, ruthenium; the organic peroxides such as benzoyl peroxide, dicumyl peroxide, di-tert-butyl peroxide; and the azo compounds such as 2,2'-azobisisobutyronitrile, 2,2'-azobis(2-methylbutyronitrile), 2,2'-azobis(2,4-dimethylvaleronitrile), and the like. These catalysts may be used alone or in combination.

Furthermore, instead of the crosslinking by the hydrosilylation reaction, or in addition to the crosslinking by the hydrosilylation reaction, crosslinking using an isocyanate crosslinking agent may be conducted. A bi- or a polyfunctional isocyanate compound may be used as the isocyanate crosslinking agent.

When crosslinking the silicone-modified urethane resin, the silicone-modified urethane resin and the ion conductive material may be mixed in advance. Examples of the ion conductive material include, but are not limited to, an inorganic ionic salts such as LiI, LiCl, $LiClO_4$, LiSCN, $LiBF_4$, $LiAsF_4$, $LiCF_2SO_2$, $LiC_6$, $LiCF_3CO_2$, $LiHgI_2$, NaI, NaSCN, NaBr, KI, CsSCN, $AgNO_3$, $CuCl_2Mg(ClO_4)_2$, and the like, which contains at least one of Li, Na, K, Cs, Ag, Cu or Mg; and an organic ionic salts such as lithium stearyl sulfonate, sodium octyl sulfonate, lithium dodecyl benzene sulfonate, sodium naphthalene sulfonate, lithium dibutyl naphthalene sulfonate, potassium octyl naphthalene sulfonate and potassium dodecyl naphthalene sulfonate and the like.

An appropriate blending ratio of the ion conductive material and the silicone-modified urethane resin is about 0.1 to about 40 parts by weight of the ion conductive material per 100 parts by weight of the silicone-modified urethane resin. With this blending ratio, when a binder resin and the ion conductive material are mixed, a volume resistivity (R) can be adjusted in a range from about $10^7$ to about $10^{11}$ Ω·cm. It may be preferable to have the ion conductive material in an ionic dissociation state prior to mixing with the silicone-modified urethane resin. To achieve this, for example, the ion conductive material may be dissolved in a solution of a polyether, such as polyethylene oxide, in a solvent, such as ether.

Ion conductive material may be ionically dissociated, for example when $LiClO_4$ is used. Li ions may be coordinated with ether oxygen atoms which originate from alkylene oxide groups, such as ethylene oxide and the like. Li ions may migrate due to mobility of the ether groups. Therefore, since uneven dispersion of the ion conductive material does not occur, it is possible to improve conductive properties of the resin layer, suppress electric charge accumulation in the resin layer, and reduce variation of the volume resistivity.

A silicone-modified urethane resin composition for covering the surface of the conductive base may be obtained by mixing the silicone-modified urethane resin and the ion conductive material and then conducting the crosslinking reaction by adding the crosslinking agent and the crosslinking catalyst. Additionally, in order to apply the silicone-modified urethane resin composition onto the surface of the conductive base, a coating solution may be prepared by dissolving the silicone-modified urethane resin composition in a predefined solvent. A coating operation may be conducted in accordance with various methods known in the art. For example, when using a dipping method, a desired silicone-modified urethane resin layer may be formed by immersing the conductive base (e.g. metal cylinder) in the coating solution, followed by pulling out, drying and then thermally treating the conductive base which may have the resin layer. A film thickness of the resin layer may be from about 5 to about 50 μm, and preferably from about 10 to about 30 μm. Furthermore, the resin layer may be formed as a single layer, or may comprise two or more layers.

A positively charged toner or a negatively charged toner may be used in the image-forming apparatus of the present invention. In order to obtain a smooth, high quality image, an appropriate range of a volume average particle diameter of the toner may be, for example, about 4.0 to about 7.5 μm. A volume average particle diameter of toners may be measured by using Multicizer III (manufactured by Beckman Coulter, Inc.) set with an aperture diameter of about 100 μm (measuring range: from about 2.0 to about 60 μm).

A known carrier may be used for the image-forming apparatus of the present invention. More specifically, a carrier with a ferrite core and a surface coated with a resin may be used. Examples of a coating resin, include, but are not limited to, conventionally known resins, such as silicone, fluorinated epoxy, fluorinated silicone, polyamide, polyamide-imide, and the like. Furthermore, an appropriate carrier particle diameter (weight average particle diameter) may be from about 25 to about 50 μm. Such a range increases toner retention by magnetic force, and helps obtain appropriate magnetic brush density which results in a smooth formation of the thin toner. Additionally, a saturation magnetization of the carrier from about 35 to about 90 emu/g may be used for a thin layer formation. The saturation magnetization of the carrier may be measured by using "VSM-P7" (manufactured by Toei Industry Co., Ltd.) set with a magnetic field of 79.6 kA/m (1 kOe).

The image-forming apparatus of the present invention, however, is not limited to the tandem type and may be any other type as long as the image-forming apparatus utilizes an electrophotographic method. And though some embodiment have been described by presenting the developing device including a developing roller and a magnetic roller, in yet other embodiments the developing device may not have a developing roller. The developing device of the present invention may be used for various developing methods such as a two component developing method, a one component developing method, and the like. Furthermore, the drum shaped photoconductor has been described in some embodiments as an example of the electrostatic latent image supporting member, the electrostatic latent image supporting member is not limited thereto. For example, in yet other embodiments a belt shaped photoconductor, a sheet shaped photoconductor, and the like may be used.

The present invention will be described in detail below using non-limiting examples.

Example 1

Fabrication of a Silicone-Modified Urethane Resin

A polysiloxane containing polyester diol of formula (I) (molecular weight: 3000, polysiloxane molecular weight: 2000, p:q=80:20)(OH: 0.054 mol) having a side chain containing a vinyl group; a polyethylene ether diol (average molecular weight 2,000 (OH: 0.025 mol)); 4,4'-diphenylmethane diisocyanate (NCO: 0.090 mol); and methyl isobutyl ketone (300 mL) were placed in a one-liter flask equipped with a thermometer and an agitation device, and dissolved by agitation.

Chemical Formula (I)

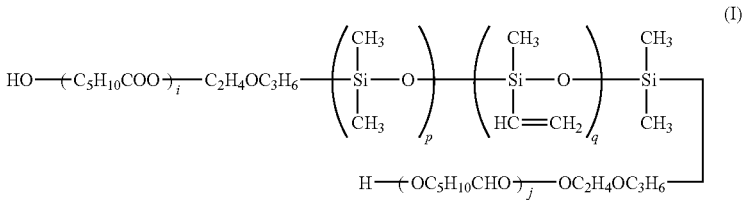

(I)

Dibutyltin dilaurate (0.1 g) was added to the reaction container and the resulting mixture was heated for 2 hours at 80° C. After the reaction solution was cooled to room temperature, 1,4-butanediol (0.9 g; OH: 0.020 mol) was added, and the contents of the reaction container were heated for 5 hours at 80° C. When the obtained material was analyzed by IR, no peak for isocyanate group was observed. On the other hand, a peak of the ether group was confirmed. This product was diluted with methyl isobutyl ketone to obtain the solid content concentration of 20 wt %. The weight average molecular weight of the obtained polymer was measured by a GPC as approximately 117000.

Manufacturing of a Developing Roller Having Silicone-Modified Urethane Resin Layer Containing an Ion Conductive Material The silicone-modified urethane resin obtained above and a solution of $LiClO_4$ were mixed by agitation in cyclohexanone used as a solvent. $LiClO_4$ was ionically dissociated beforehand by adding $LiClO_4$ to a solution of polyethylene oxide in ether. After mixing, a solution of polyisocyanate crosslinking agent in ethyl acetate at a ratio of 50 wt % to 50 wt %, respectively, and a platinum catalyst were added to the mixture in cyclohexanone solvent and mixed to obtain a coating solution. The obtained coating solution was applied to the surface of an aluminum base by a dipping method. After the coating, the solution-coated aluminum base was heated for 40 minutes at 150° C. and crosslinking reaction of the resin was conducted, which resulted in a developing roller having a silicone-modified urethane resin layer (thickness: 10 μm) containing an ion conductive material. The lithium perchlorate ($Li^+ClO_4^-$), which is the ion conductive material, constituted 30 wt % of the silicone-modified urethane resin.

Evaluation Test

The following test was conducted by using the image-forming apparatus shown in FIG. 1, by means of the developing roller that has the silicone-modified urethane resin layer that contains the ion conductive material obtained above. The image-forming apparatus was set such that drum rotation speed is 400 mm/sec, the drum surface potential is 350 V, and an electrical potential after exposure is 20 V. The developing roller rotation speed/drum shaped photoconductor rotation speed (S/D) is 1.5 and the magnetic roller rotation speed/developing roller rotation speed (M/S) is 1.5. The developer used had an electrostatic charge amount of toner Q/M of 15 to 20 μC/g, a toner volume average diameter of 6.5 μm, and a carrier weight average particle diameter of 35 μm. A development bias voltage on the developing roller was applied as follows: Vdc2=300V, Vpp=1.6 kV, frequency f=2.7 kHz, duty ratio=40%. An applied voltage on the magnetic roller was Vdc1=400 V, while conditions of Vpp=2.8 kV, frequency f=2.7 kHz, duty ratio=70%, having the same cycle but opposite phase of the voltage applied to developing roller. An electrostatic charge amount of a toner on the developing roller surface, at a stabilization time point when the image-forming apparatus is stabilized under the above condition, was compared with an electrostatic charge amount of a toner that was aged for 20 seconds after the stabilization time point at 25° C. The electric charge amount of the toner at the stabilization time point was 16 μC/g, while the electric charge amount of the toner after 20 seconds of aging after the stabilization time point was 17 μC/g. Additionally, when a solid image was printed, a sufficient image density was obtained in the printed solid image with the developing condition described above after 20 seconds of aging after the stabilization time point. The developing device was operating in this period. The electric charge amount was measured by a QM meter (MODEL 210HS) manufactured by TREK Inc.

Example 2

A developing roller was obtained in a similar manner as described in example 1, except that tetrabutyl ammonium bromide was used instead of LiClO4. An evaluation similar to that of example 1 was conducted by using the obtained developing roller. The evaluation results showed the electric charge amount of the toner was 17 μC/g at the stabilization time point, and was 18 μC/g when aged for 20 seconds after the stabilization time point. Furthermore, when a solid image was printed as in example 1, a sufficient image density was obtained in the printed solid image.

Comparative Example 1

A developing roller was manufactured in a similar manner as described in example 1 for a silicone-modified urethane resin, except that polyethylene ether diol was not used. An evaluation similar to that of example 1 was conducted by using the obtained developing roller. The evaluation results showed the electric charge amount of the toner was 18 μC/g at the stabilization time point, and 23 μC/g when aged for 20 seconds after the stabilization time point. Furthermore, when a solid image was printed as in example 1, an insufficient image density was generated in the printed solid image.

Comparative Example 2

A developing roller was manufactured in the same manner as described in example 1 for a silicone-modified urethane resin, except that carbon black was used instead of $LiClO_4$. An evaluation similar to that of example 1 was conducted by using the obtained developing roller. As a result, the electric charge amount of the toner was 19 μC/g at the stabilization time point, and 25 μC/g when aged for 20 seconds after the stabilization time point. Furthermore, when a solid image was printed as in example 1, an insufficient image density was generated in the printed solid image.

The above described examples and comparative examples show that the resin layer in the examples the reduces electric charge accumulation that results in suppression of an electrical charge-up of the toner which then allows a sufficient image density to be obtained.

The developing device according to an embodiment of the present invention comprises: a developing roller disposed in an opposed position to an electrostatic latent image supporting member, and further supporting and conveying a toner on a surface thereof; and a conductive base surface of the developing roller covered with a resin layer and further containing an ion conductive material. Furthermore, the resin layer may contain a silicone-modified urethane resin, which may have an ether structure. In the above developing device of the present invention, electric charge accumulation in the resin layer may be suppressed. Suppression of the electric charge accumulation in resin may occur because the ether group introduced in the silicone-modified urethane resin may form a crown ether-like structure together with the ion conductive material (e.g. $Li^+$ of lithium perchlorate ($Li^+ClO4^-$)). The conductivity of the resin layer and dispersibility of the ion conductive material are improved. Additionally, the developing device according to an embodiment of the present invention comprises: a developing roller, which may support and convey a toner on a surface thereof; a magnetic roller that may support a two-component developer containing the toner and a carrier, and may convey the toner to the developing roller; and a conductive base surface of the developing roller that may be covered with a resin layer containing an ion conductive material. Furthermore, the resin layer may contain a silicone-modified urethane resin, which may have an ether structure. In the above described developing device of the present invention, an electric charge-up may be suppressed in the toner delivered from the magnetic roller to the developing roller. Further, a thin layer of toner may be uniformly formed on the developing roller. The ether group introduced in the silicone-modified urethane resin may form a crown ether-like structure together with the ion conductive material (e.g. $Li^+$ of lithium perchlorate ($Li^+ClO4^-$)). Therefore it follows that conductivity of the resin layer and dispersibility of the ion conductive material are improved, which allows suppression of the electric charge-up and allows formation of uniformly formed thin layers. Additionally, since a film thickness of the resin layer may be from about 5 μm to about 50 μm, the resin layer may maintain an appropriate conductivity. Furthermore, since the use of positively charged toner allows the toner on the developing roller to not be charged-up electrically and in-turn may help to produce a preferable image. Still further, the image-forming apparatus of the present invention having the developing device described herein may suppress both electric charge accumulation in the resin layer and electrical charge-up of the toner. Therefore the generation of an undesired image density may be prevented and a high quality image may be obtained.

Although the embodiments of the present invention are described above, the scope of the present invention is not limited thereto and various modifications may be added as long as the modifications do not depart from the scope of the essence of the invention.

Having thus described in detail the preferred embodiments of the present invention, it is to be understood that the invention defined by the foregoing paragraphs is not to be limited to particular details and/or embodiments set forth in the above description, as many apparent variations thereof are possible without departing from the spirit or scope of the present invention.

What is claimed is:

1. A resin for covering the surface of a conductive base of a developing roller, the resin comprising a silicone-modified urethane resin having an ether structure and an ion conductive material, wherein the resin is a product of a crosslinking reaction of the silicone-modified urethane resin and the ion conductive material in the presence of a crosslinking agent and a crosslinking catalyst.

2. The resin according to claim 1 wherein the crosslinking agent is a bifunctional isocyanate compound.

3. The resin according to claim 1 wherein the silicone-modified urethane polymer is obtained by reacting a diol component containing a silicone diol having hydroxyl groups and polycarbonate diol with a bifunctional isocyanate compound.

4. The resin according to claim 3 wherein the bifunctional isocyanate further comprises a side chain having an ether group.

5. The resin according to claim 3 wherein the bifunctional isocyanate further comprises a side chain containing one or more unsaturated aliphatic hydrocarbon groups.

6. The resin according to claim 1 wherein the silicone-modified urethane polymer further comprises the side chains having one or more unsaturated aliphatic hydrocarbon groups.

7. The resin according to claim 3 wherein the diol component comprises a side chain having the ether groups.

8. The resin according to claim 7 wherein the dial component further comprises a side chain having one or more unsaturated aliphatic hydrocarbon groups.

9. The resin according to claim 1 wherein the ion conductive material is an inorganic ionic salt selected from the group consisting of LiI, LiCl, $LiClO_4$, LiSCN, $LiBF_4$, $LiAsF_4$, $LiCF_2SO_2$, $LiC_6$, $LiCF_3CO_2$, $LiHgI_2$, NaI, NaSCN, NaBr, KI, CsSCN, $AgNO_3$, $CuCl_2$ $Mg(ClO_4)_2$, which contains at least one of Li, Na, K, Cs, Ag, Cu or Mg; or an organic ionic salt selected from the group consisting of lithium stearyl sulfonate, sodium octyl sulfonate, lithium dodecyl benzene sulfonate, sodium naphthalene sultanate, lithium dibutyl naphthalene sulfonate, potassium octyl naphthalene sulfonate and potassium dodecyl naphthalene sulfonate.

10. A developing roller comprising a conductive base, wherein the surface of the conductive base is covered with a resin containing a silicone-modified urethane resin having an ether structure and an ion conductive material; and the resin is a product of a crosslinking reaction of the silicone-modified urethane resin and the ion conductive material in the presence of a crosslinking agent and a crosslinking catalyst.

11. The developing roller according to claim 10 wherein the crosslinking agent is a bifunctional isocyanate compound.

12. The developing roller according to claim 10 wherein the silicone-modified urethane polymer is obtained by reacting a diol component containing a silicone diol having hydroxyl groups and polycarbonate diol with a bifunctional isocyanate compound.

13. The developing roller according to claim 12 wherein the bifunctional isocyanate further comprises a side chain having an ether group.

14. The developing roller according to claim 12 wherein the bifunctional isocyanate further comprises a side chain containing one or more unsaturated aliphatic hydrocarbon groups.

15. The developing roller according to claim 10 wherein the silicone-modified urethane polymer further comprises the side chains having one or more unsaturated aliphatic hydrocarbon groups.

16. The developing roller according to claim 12 wherein the diol component comprises a side chain having the ether groups.

17. The developing roller according to claim 16 wherein the diol component further comprises a side chain having one or more unsaturated aliphatic hydrocarbon groups.

18. The developing roller according to claim 10 wherein the ion conductive material is an inorganic ionic salt selected from the group consisting of LiI, LiCl, $LiClO_4$, LiSCN, $LiBF_4$, $LiAsF_4$, $LiCF_2SO_2$, $LiC_6$, $LiCF_3CO_2$, $LiHgI_2$, NaI, NaSCN, NaBr, KI, CsSCN, $AgNO_3$, $CuCl_2Mg(ClO_4)_2$, which contains at least one of Li, Na, K, Cs, Ag, Cu or Mg; or an organic ionic salt selected from the group consisting of lithium stearyl sulfonate, sodium octyl sulfonate, lithium dodecyl benzene sulfonate, sodium naphthalene sulfonate, lithium dibutyl naphthalene sulfonate, potassium octyl naphthalene sulfonate and potassium dodecyl naphthalene sulfonate.

19. An image forming apparatus including a developing device comprising:

a developing roller disposed in an opposed position to an electrostatic latent image supporting member, the developing roller being configured for supporting and conveying a toner thereof, and a magnetic roller configured for supporting a two-component developer material containing the toner and a carrier, and conveying the toner to the developing roller, wherein a conductive base surface of the developing roller is covered with a resin containing a silicone-modified urethane resin having an ether structure and an ion conductive material; and the resin is a product of a crosslinking reaction of the silicone-modified urethane resin and the ion conductive material in the presence of a crosslinking agent and a crosslinking catalyst.

20. The image forming apparatus according to claim 19 wherein the ion conductive material is an inorganic ionic salt selected from the group consisting of LiI, LiCl, $LiClO_4$, LiSCN, $LiBF_4$, $LiAsF_4$, $LiCF_2SO_2$, $LiC_6$, $LiCF_3CO_2$, $LiHgI_2$, NaI, NaSCN, NaBr, KI, CsSCN, $AgNO_3$, $CuCl_2Mg(ClO_4)_2$, which contains at least one of Li, Na, K, Cs, Ag, Cu or Mg; or an organic ionic salt selected from the group consisting of lithium stearyl sulfonate, sodium octyl sulfonate, lithium, dodecyl benzene sulfonate, sodium naphthalene sulfonate, lithium dibutyl naphthalene sulfonate, potassium octyl naphthalene sulfonate and potassium dodecyl naphthalene sulfonate.

* * * * *